US009206763B2

(12) United States Patent
Miyata

(10) Patent No.: US 9,206,763 B2
(45) Date of Patent: Dec. 8, 2015

(54) ENGINE AND STRADDLE-TYPE VEHICLE

(71) Applicant: YAMAHA HATSUDOKI KABUSHIKI KAISHA, Iwata-shi, Shizuoka (JP)

(72) Inventor: Manabu Miyata, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 121 days.

(21) Appl. No.: 14/254,963

(22) Filed: Apr. 17, 2014

(65) Prior Publication Data

US 2014/0345558 A1 Nov. 27, 2014

(30) Foreign Application Priority Data

May 24, 2013 (JP) ..... 2013-109819

(51) Int. Cl.

| | |
|---|---|
| ***F02F 1/42*** | (2006.01) |
| ***F02F 1/24*** | (2006.01) |
| ***F02P 13/00*** | (2006.01) |
| *H01T 13/16* | (2006.01) |

(52) U.S. Cl.

CPC ..... *F02F 1/242* (2013.01); *F02P 13/00* (2013.01); *H01T 13/16* (2013.01)

(58) Field of Classification Search

CPC ..... F02F 1/242; F02F 1/42; F02P 13/00; H01T 13/00; H01T 13/06; H01T 13/16; H01T 13/40

USPC ..... 123/193.3, 146.5, 41.32, 635, 647

See application file for complete search history.

(56) References Cited

U.S. PATENT DOCUMENTS

| | | | | | |
|---|---|---|---|---|---|
| 2,283,959 | A * | 5/1942 | Vincent | F02F 1/12 | 123/41.32 |
| 5,842,458 | A * | 12/1998 | Alstrin | H01T 13/08 | 123/169 PA |
| 5,878,706 | A * | 3/1999 | Akamatsu | H01T 13/06 | 123/143 C |

FOREIGN PATENT DOCUMENTS

| | | | |
|---|---|---|---|
| GB | 2 041 492 | A | 9/1980 |
| JP | 60-167144 | U | 11/1985 |
| JP | 62-28301 | B2 | 6/1987 |
| JP | 05-240108 | A | 9/1993 |
| JP | 2009-133219 | A | 6/2009 |

* cited by examiner

*Primary Examiner* — Lindsay Low
*Assistant Examiner* — Grant Moubry
(74) *Attorney, Agent, or Firm* — Keating and Bennett, LLP

(57) ABSTRACT

An engine of a straddle-type vehicle includes a seal between a surrounding wall and a pipe. A cylinder head includes a first surrounding wall portion and a second surrounding wall portion. One end of the pipe is pressed in against the first surrounding wall portion. The second surrounding wall portion is located more distant from an attachment portion than the first surrounding wall portion is, and has an inner diameter larger than that of the first surrounding wall portion. The pipe includes an annular projection. The annular projection projects from the outer periphery of the pipe, and divides a space defined by the outer periphery of the pipe and the inner periphery of the second surrounding wall portion into subspaces arranged in an axial direction of the pipe when the one end of the pipe is pressed in against the first surrounding wall portion.

10 Claims, 10 Drawing Sheets

CROSS-SECTIONAL VIEW TAKEN ON LINE V-V

CROSS-SECTIONAL VIEW TAKEN ON LINE VI-VI

CROSS-SECTIONAL VIEW TAKEN ON LINE IX-IX

ENGINE AND STRADDLE-TYPE VEHICLE

BACKGROUND OF THE INVENTION

1. Field of the Invention

The present invention relates to an engine and a straddle-type vehicle, and more particularly, to an engine with a pipe surrounding a spark plug and a straddle-type vehicle including such an engine.

2. Description of the Related Art

Straddle-type vehicles include motorcycles, for example. A motorcycle includes an engine. An engine is disclosed in JP 2009-133219 A, for example.

In the engine of JP 2009-133219 A, a plug tube is provided to surround the spark plug. The plug tube is held in a support cylindrical part. An O-ring is provided between the side wall of the plug tube and the support cylindrical part to provide a seal.

In JP 2009-133219 A, a concave groove is provided on the side wall of the plug tube, the groove having an opening at the outer periphery of the side wall. The O-ring is located in this concave groove. That is, according to JP 2009-133219 A, a concave groove in which the O-ring is to be positioned must be formed in the plug tube. As such, according to JP 2009-133219 A, a complicated arrangement for providing a seal between the side wall of the plug tube and the support cylindrical part must be provided.

SUMMARY OF THE INVENTION

Preferred embodiments of the present invention provide an engine in which a seal between a surrounding wall and a pipe is easily established, and a straddle-type vehicle including such an engine.

An engine according to a first preferred embodiment of the present invention includes a cylinder head, a spark plug and a pipe. The spark plug is attached to the cylinder head. The pipe is located around the spark plug. The cylinder head includes an attachment portion and a surrounding wall. The spark plug is attached to the attachment portion. The surrounding wall is located around the spark plug and extends in a first direction. The first direction is an axial direction of the pipe. The surrounding wall includes a first surrounding wall portion and a second surrounding wall portion. One end of the pipe is pressed in against the first surrounding wall portion. The second surrounding wall portion is located more distant from the attachment portion than the first surrounding wall portion is as measured in the first direction, and has an inner diameter larger than that of the first surrounding wall portion. The pipe includes an annular projection. The annular projection projects from the outer periphery of the pipe, and divides the space defined by the outer periphery of the pipe and the inner periphery of the second surrounding wall portion into subspaces arranged in the first direction when the one end of the pipe is pressed in against the first surrounding wall portion. A liquid gasket is contained in a first subspace which is closer to the first surrounding wall portion than the annular projection is.

In the above engine, the pipe is pressed in against the first surrounding wall portion. Pressing in the pipe provides a seal between the outer periphery of the pipe and the inner periphery of the first surrounding wall portion.

Further, in the above engine, the liquid gasket is contained in the first subspace, which is the one of the subspaces defined between the outer periphery of the pipe and the inner periphery of the second surrounding wall portion that is closer to the first surrounding wall portion than the annular projection is.

The liquid gasket provides a seal between the outer periphery of the pipe and the inner periphery of the second surrounding wall portion.

In the above engine, a seal structure implemented by a liquid gasket is preferably included in addition to the seal structure implemented by pressing in the pipe. The seal structure implemented by the liquid gasket further improves the seal performance of the seal structure implemented by pressing in the pipe.

In addition, in the above engine, the annular projection prevents the liquid gasket from leaking from the first subspace.

Thus, in the above engine, a seal between the surrounding wall and pipe is easily provided.

In an engine according to another preferred embodiment of the present invention, the surrounding wall preferably includes a third surrounding wall portion. The third surrounding wall portion is located between the first and second surrounding wall portions as measured in the first direction and couples the first surrounding wall portion with the second surrounding wall portion. The third surrounding wall portion includes a tapered inner periphery. The tapered inner periphery connects the inner periphery of the first surrounding wall portion with the inner periphery of the second surrounding wall portion, and has an inner diameter that increases as it goes from the first surrounding wall portion toward the second surrounding wall portion.

In the above engine, the liquid gasket may easily enter the gap between the pipe and the press-in surface of the first surrounding wall portion due to wedge effects. As such, the seal property between the pipe and the surrounding wall is significantly improved.

In an engine according to another preferred embodiment of the present invention, the surrounding wall preferably further includes an annular surface. The annular surface is connected with the inner periphery of the first surrounding wall portion and expands in directions perpendicular or substantially perpendicular to the first direction. When the one end of the pipe is pressed in against the first surrounding wall portion, a gap is defined between the one end of the pipe and the annular surface.

In the above engine, the size of the gap defined between the one end of the pipe as measured in the first direction and the annular surface may be adjusted appropriately to compress the liquid gasket in the first subspace. As such, the seal property between the pipe and surrounding wall is significantly improved.

Further, when the pipe is pressed in, the pipe may be prevented from buckling since the one end of the pipe does not contact the annular surface.

An engine according to a further preferred embodiment of the present invention, preferably further includes ahead cover. The head cover is attached to the cylinder head. The head cover includes a cylindrical wall. When attached to the cylinder head, the cylindrical wall is located around the pipe. The engine further includes a seal member. The seal member is located between the inner periphery of the cylindrical wall and the outer periphery of the pipe.

In the above engine, a seal may be provided between the head cover and pipe.

In an engine according to another preferred embodiment of the present invention, the cylindrical wall preferably is located around the other end of the pipe which is opposite the one end as measured in the first direction. The seal member includes a stop. The stop is located more distant from the spark plug than the other end of the pipe as measured in the first direction. The stop overlaps the other end as viewed in the first direction.

In the above engine, movement of the pipe in an axial direction thereof (i.e., the first direction) is restricted. As such, the pipe is prevented from moving out of the first surrounding wall portion.

In an engine according to another preferred embodiment of the present invention, the stop preferably is in contact with the other end when the seal member is located between the inner periphery of the cylindrical wall and the outer periphery of the pipe.

In the above engine, the pipe is prevented from moving out of the first surrounding wall portion.

In an engine according to yet another preferred embodiment of the present invention, the seal member preferably includes a support clasp and seal rubber. The seal rubber is bonded to the support clasp. The support clasp includes a cylindrical portion and a stop piece. The cylindrical portion is located between the pipe and the cylindrical wall. The stop piece is located more distant from the spark plug than the other end is as measured in the first direction. The stop piece overlaps the other end as viewed in the first direction. The stop piece defines the stop.

In the above engine, a portion of the support clasp (i.e., the stop piece) defines the stop, thus ensuring a certain strength of the stop.

In an engine according to another preferred embodiment of the present invention, the seal rubber preferably includes a first rubber portion and a second rubber portion. The first rubber portion is bonded to the outer periphery of the cylindrical portion. The second rubber portion is bonded to the inner periphery of the cylindrical portion. When the seal member is located between the inner periphery of the cylindrical wall and the outer periphery of the pipe, the first rubber portion is compressed between the cylindrical portion and the cylindrical wall and the second rubber portion is compressed between the cylindrical portion and the pipe.

In the above engine, the first rubber portion is compressed between the cylindrical portion and the cylindrical wall, thus providing a seal between the cylindrical portion and the cylindrical wall. Further, the second rubber portion is compressed between the cylindrical portion and the pipe, thus providing a seal between the cylindrical portion and the pipe.

In an engine according to another preferred embodiment of the present invention, the cylindrical wall preferably includes a first inner periphery portion, a second inner periphery portion and a step surface. The second inner periphery portion is located more distant from the spark plug than the first inner periphery portion is as measured in the first direction, and has an inner diameter smaller than that of the first inner periphery portion. The step surface connects the first inner periphery portion with the second inner periphery portion. The seal member is located between the first inner periphery portion and the outer periphery of the pipe. The seal member overlaps the step surface as viewed in the first direction.

In the above engine, the seal member is prevented from moving out of the location between the cylindrical wall and the pipe.

A straddle-type vehicle according to yet another preferred embodiment of the present invention includes an engine according to any one of the above-described preferred embodiments of the present invention.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Now, a straddle-type vehicle according to preferred embodiments of the present invention will be described with reference to the drawings. In the description of the present preferred embodiments, the straddle-type vehicle preferably is a motocrosser-type motorcycle, for example. The same or corresponding elements in various drawings are labeled with the same characters and their description will not be repeated.

Figure 1:
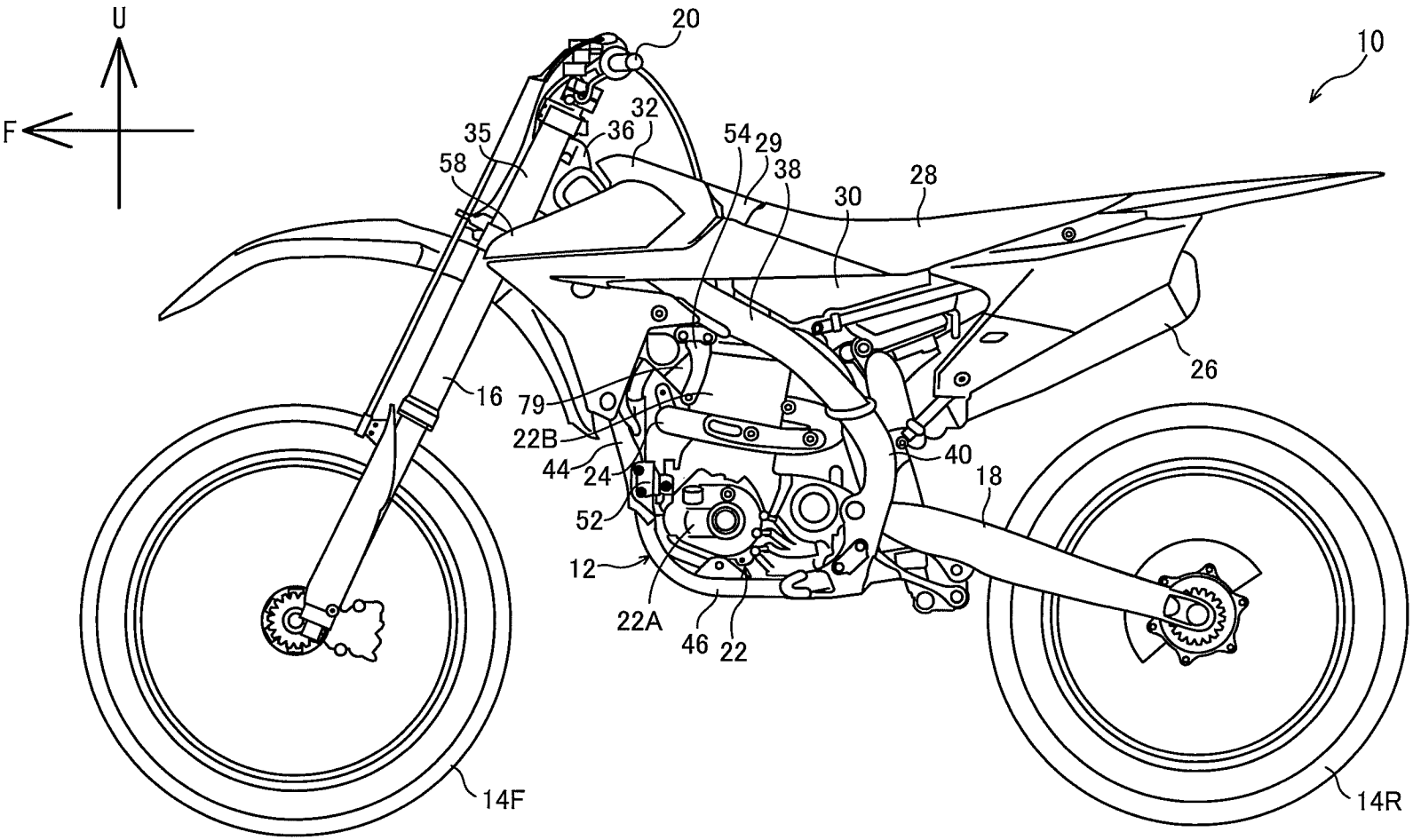
FIG. 1 is a left side view of a motorcycle according to a preferred embodiment of the present invention.

FIG. 1 is a left side view of a motorcycle 10 according to the present preferred embodiment of the present invention. In the following description, front/forward, rear/rearward, left and right indicate directions as perceived by a rider sitting on the seat 28 of the motorcycle 10. In FIG. 1, arrow F indicates the forward direction with respect to the motorcycle 10, and arrow U the upward direction with respect to the motorcycle 10.

The motorcycle 10 includes a body frame 12, a front wheel 14F, a rear wheel 14R, a front suspension 16, a rear arm 18, handlebars 20, an engine 22, an exhaust pipe 24, a muffler 26, a seat 28, a fuel tank 30 and an air cleaner 32.

Figure 2:
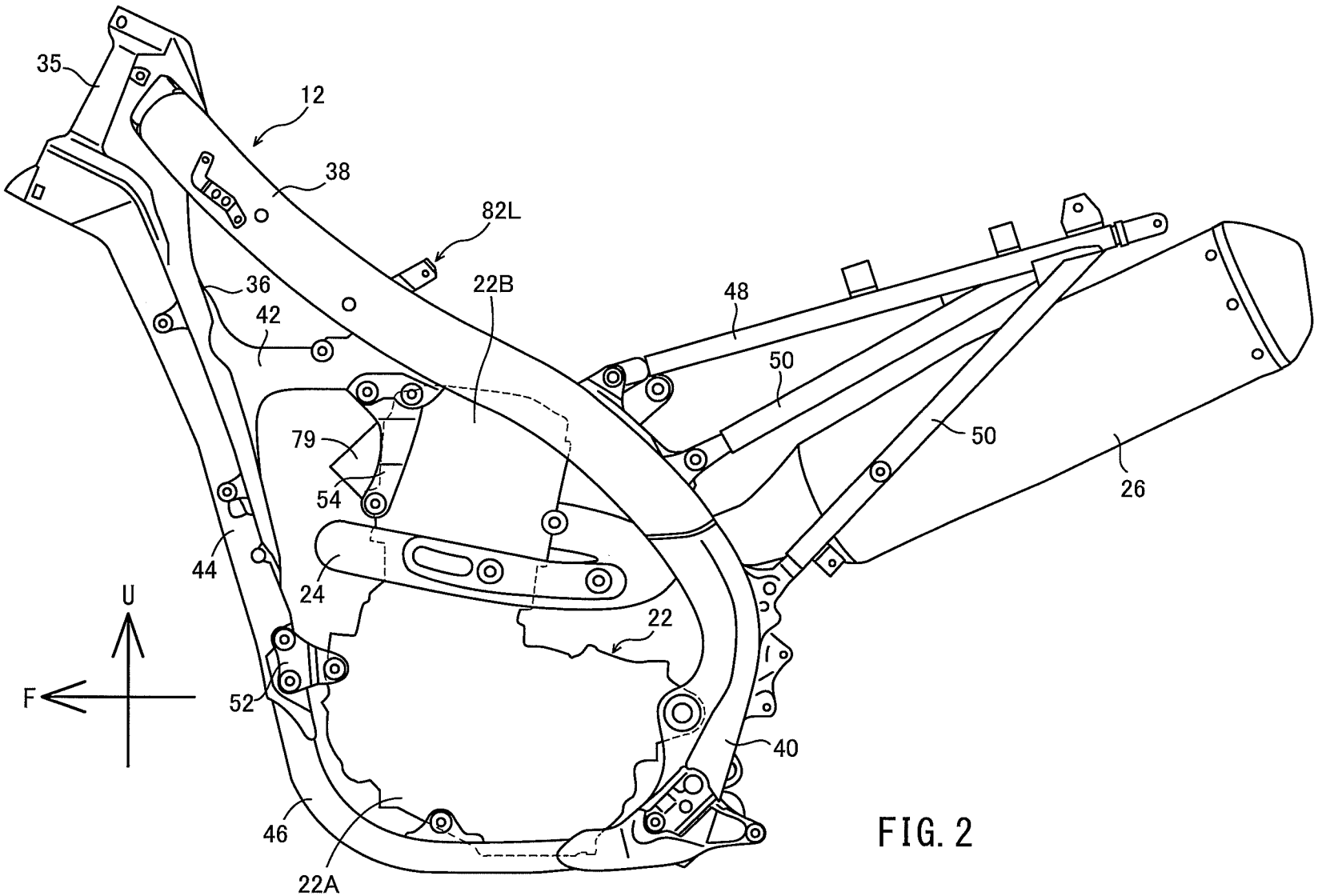
FIG. 2 is a left side view of the body frame.
Figure 3:
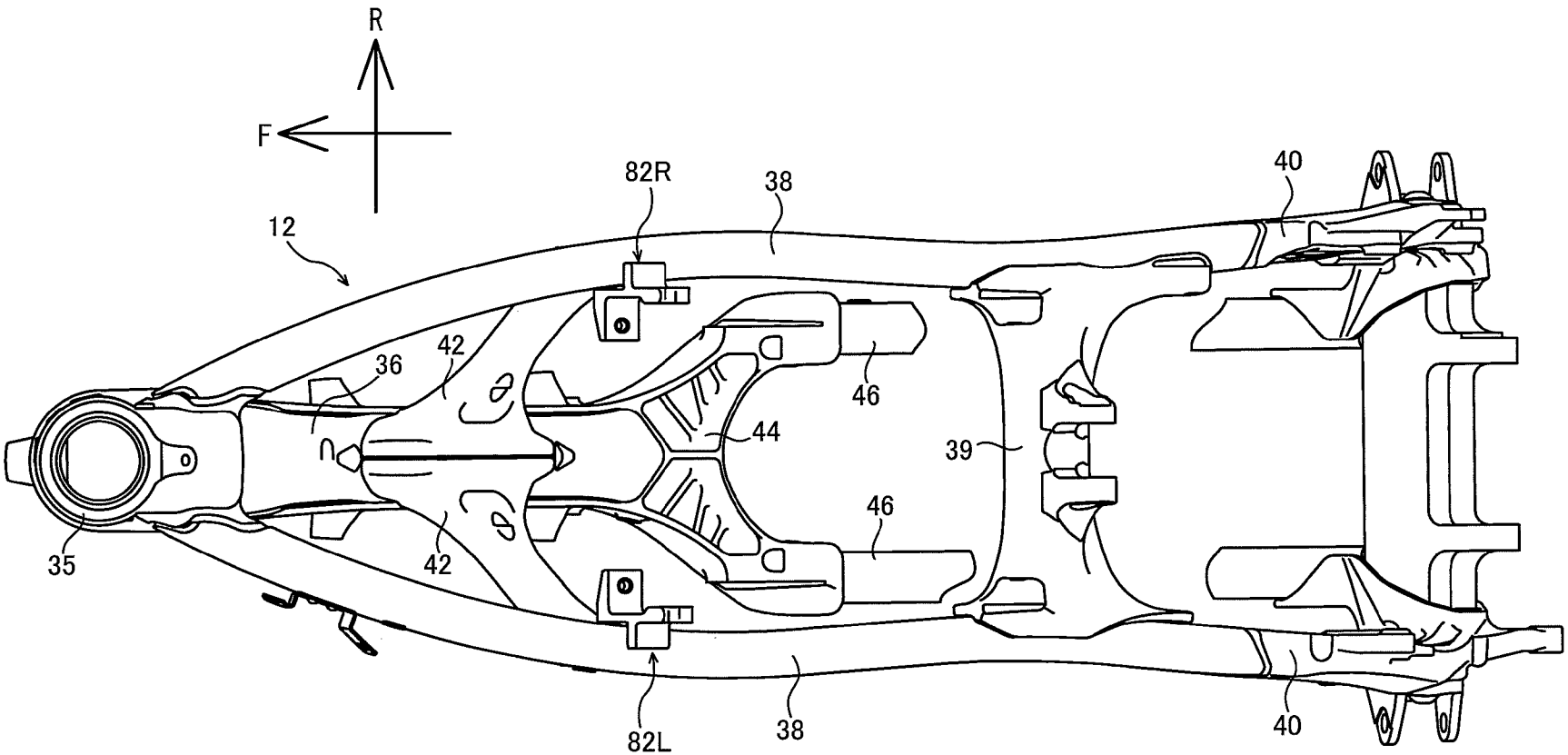
FIG. 3 is a plan view of the body frame.

The body frame 12 will be described with reference to FIGS. 2 and 3. FIG. 2 is a left side view of the body frame 12. FIG. 3 is a plan view of the body frame. In FIG. 2, arrow F indicates the forward direction with respect to the motorcycle 10, and arrow U the upward direction with respect to the motorcycle 10. In FIG. 3, arrow F indicates the forward direction with respect to the motorcycle 10, and arrow R the right direction with respect to the motorcycle 10.

The body frame 12 includes a head pipe 35, a pair of main frames 38, to the left and right, a pair of pivot frames 40, to the left and right, a pair of support frames 42, to the left and right, a down frame 44, a pair of lower frames 46, to the left and right, a pair of seat frames 48, to the left and right, and a pair of back stays 50, to the left and right.

The head pipe 35 is located at the front end of the body frame 12. A connecting frame 36 is connected with the rear end of the head pipe 35. A steering shaft, not shown, is inserted through the head pipe 35. The connecting frame 36 extends rearward and downward from the head pipe 35.

The main frames 38 are connected with the connecting frame 36. The main frames 38 are spaced apart from each other in a vehicle width direction. Each of the main frames 38 extends rearward and downward from the connecting frame 36. That is, the main frames 38 extend rearward from the connecting frame 36.

As shown in FIG. 3, a cross member 39 is located between the main frames 38. The cross member 39 couples the main frames 38 with each other.

The down frame 44 is connected with the bottom end of the head pipe 35. The down frame 44 extends rearward and downward from the bottom end of the head pipe 35. The down frame 44 is connected with the connecting frame 36. That is, the connecting frame 36 couples the head pipe 35 with the down frame 44.

The lower frames 46 are connected with the down frame 44. The lower frames 46 are spaced apart from each other in a vehicle width direction. Each of the lower frames 46 extends rearward and downward from the down frame 44.

The pivot frames 40 are spaced apart from each other in a vehicle width direction. The left pivot frame 40 couples the left main frame 38 with the left lower frame 46. The right pivot frame 40 couples the right main frame 38 with the right lower frame 46.

The support frames 42 are spaced apart from each other in a vehicle width direction. The left support frame 42 couples the connecting frame 36 with the left main frame 38. The right support frame 42 couples the connecting frame 36 with the right main frame 38.

The seat frames 48 are spaced apart from each other in a vehicle width direction. The left seat frame 48 is connected with the cross member 39 and extends rearward and upward from the cross member 39. The right seat frame 48 is connected with the cross member 39 and extends rearward and upward from the cross member 39.

The back stays 50 are spaced apart from each other in a vehicle width direction. The left back stay 50 couples the left seat frame 48 with the left pivot frame 40. The right back stay 50 couples the right seat frame 48 with the cross member 39.

Returning to FIG. 1, the front wheel 14F is rotatably supported by the front suspension 16. The front wheel 14F swings to the left and right as the handlebars 20 are operated. Meters (not shown) are located near the handlebars 20.

The rear wheel 14R is rotatably supported by the rear arms 18 attached to the respective pivot frames 40. The rear wheel 14R rotates as power from the engine 22 is transmitted thereto.

The engine 22 is supported by the body frame 12. More specifically, as shown in FIGS. 1 and 2, the engine 22 is attached to the body frame 12 by a plurality of brackets 52 and 54. Still more specifically, the crankcase 22A of the engine 22 is attached to the down frame 44 by the brackets 52, located to the left and right. The cylinder 22B of the engine 22 is attached to the support frames 42 by the brackets 54, located to the left and right. A bottom portion of the crankcase 22A is attached to the lower frames 46, and a rear portion of the crankcase 22A is attached to the pivot frames 40.

As shown in FIG. 1, the exhaust pipe 24 is connected with the engine 22. The exhaust pipe 24 extends from an exhaust port located on the rear side of the cylinder 22B to surround the cylinder 22B. The muffler 26 is connected with the downstream end of the exhaust pipe 24.

The seat 28 is attached to the seat frames 48. The fuel tank 30 is attached to the main frames 38 and seat frames 48. A tank cover 29 is located forward of the seat 28. The tank cover 29 covers the fill opening of the fuel tank 30. The air cleaner 32 is attached to the connecting frame 36 and main frames 38. A pair of air intake ducts 58, to the left and right, are connected with the air cleaner 32.

Figure 4:
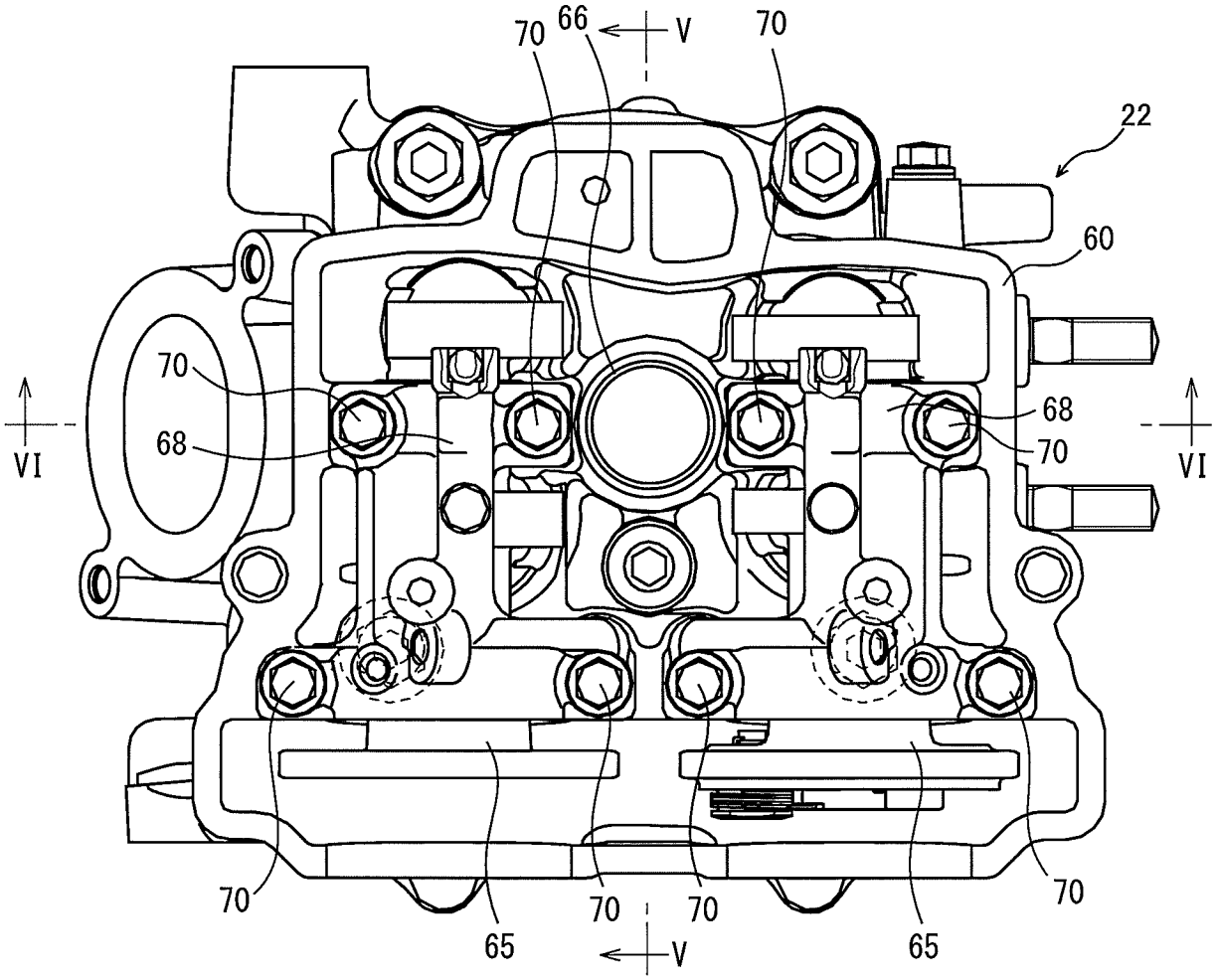
FIG. 4 is a plan view of the cylinder without the head cover.
Figure 5:
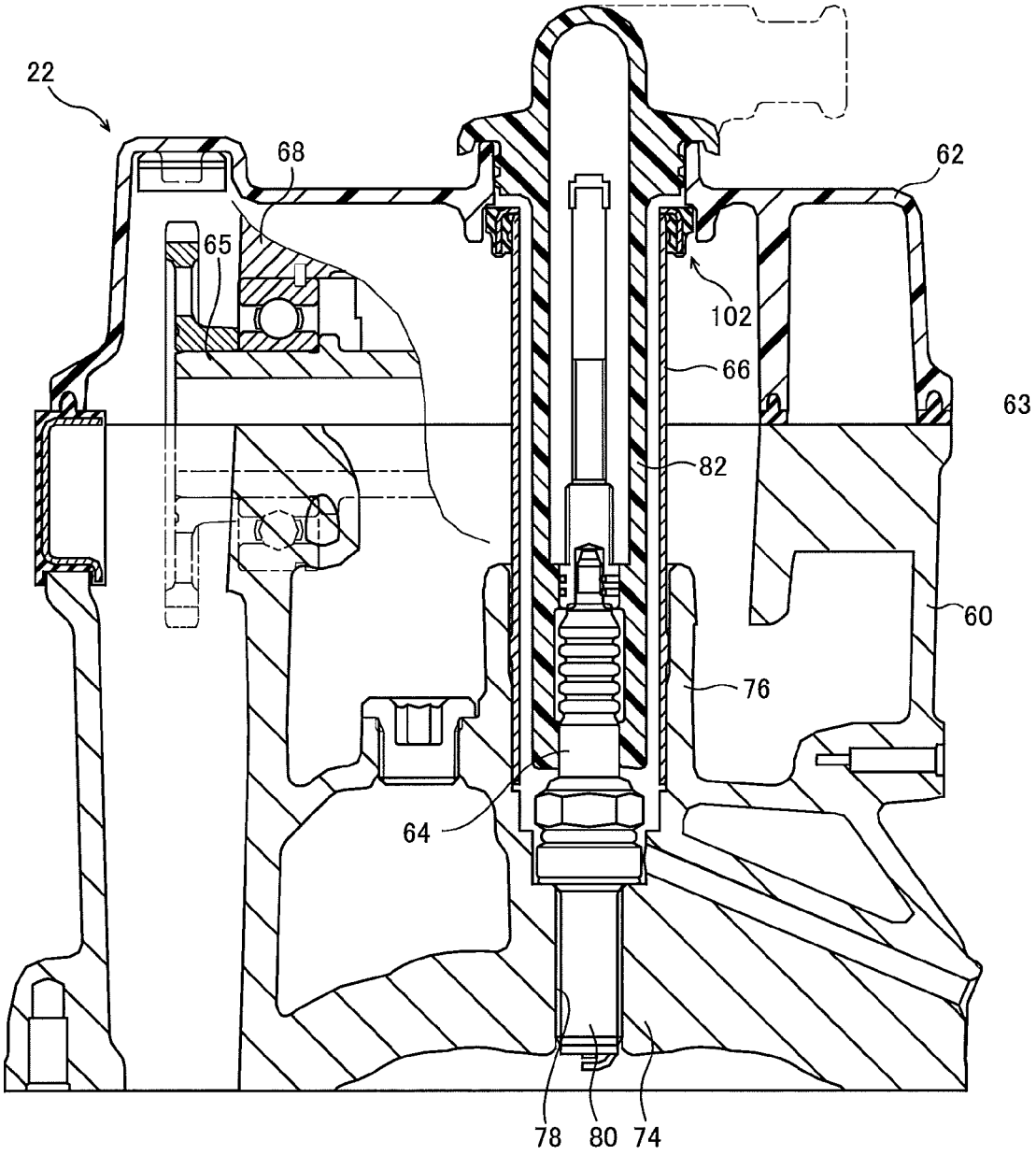
FIG. 5 is a cross-sectional view taken on line V-V of FIG. 4.
Figure 6:
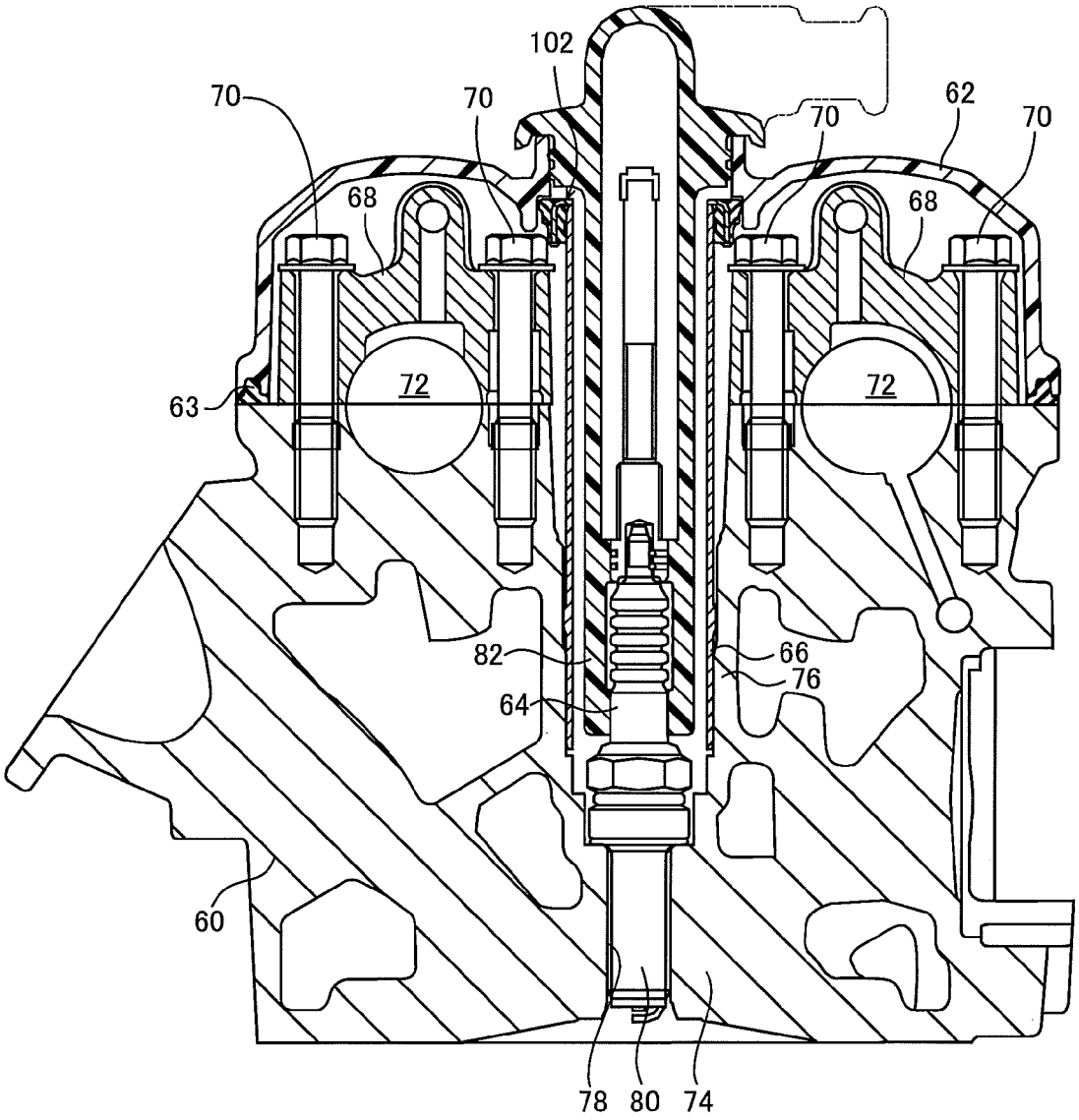
FIG. 6 is a cross-sectional view taken on line VI-VI of FIG. 4.

The engine 22 will be described with reference to FIGS. 4 to 6. FIG. 4 is a plan view of the cylinder head 60 without the head cover 62. FIG. 5 is a cross-sectional view taken on line V-V of FIG. 4. FIG. 6 is a cross-sectional view taken on line VI-VI of FIG. 4.

As shown in FIGS. 5 and 6, the engine 22 includes a cylinder head 60, head cover 62, spark plug 64 and pipe 66. The cylinder head 60 is attached to the cylinder body and, in combination with the cylinder body, defines the combustion chamber. The head cover 62 is attached to the cylinder head 60. Seal members 63 are disposed between the head cover 62 and cylinder head 60. The spark plug 64 is attached to the cylinder head 60. The pipe 66 is located around the spark plug 64.

As shown in FIG. 4, the engine 22 further includes two camshafts 65. In a plan view of the cylinder head 60, the pipe 66 is located between the two camshafts 65.

The camshafts 65 are located between the cylinder head 60 and a cover member 68 attached to the cylinder head 60. More specifically, the cover member 68 is attached to the cylinder head 60 by a plurality of bolts 70, for example. As shown in FIG. 6, spaces 72 are provided between the cover member 68 and cylinder head 60. The camshafts 65 are located in these spaces 72. In FIG. 6, the camshafts 65 are not shown.

Since the pipe 66 is located around the spark plug 64, the distance between the two camshafts 65 is significantly reduced. The size of the engine 22 is significantly reduced compared with implementations where a surrounding wall that is integral with the cylinder head 60 is located around the spark plug 64.

Further, only an annular projection 90 projects from the outer periphery 92 of the pipe 66, as discussed below. As such, even if the distance between the two camshafts 65 is reduced, a tool used to fasten bolts 70 located near the pipe 66 is prevented from contacting the pipe 66. This will ensure a certain work area needed when the bolts 70 are fastened, thus improving the workability.

As shown in FIGS. 5 and 6, the cylinder head 60 includes an attachment portion 74 and a surrounding wall 76.

The spark plug 64 is attached to the attachment portion 74. More specifically, a threaded hole 78 is provided in the attachment portion 74. The spark plug 64 includes a threaded portion 80. The threaded hole 78 and threaded portion 80 are used to attach the spark plug 64 to the attachment portion 74.

The surrounding wall 76 is located around the spark plug 64. More specifically, the surrounding wall 76 is located around the portions of the spark plug 64 to which the plug cap 82 is attached. The surrounding wall 76 extends in a first direction, which is a top-to-bottom direction in FIGS. 5 and 6. The first direction can also be referred to as an axial direction of the pipe 66 or a height direction of the surrounding wall 76.

Figure 7:
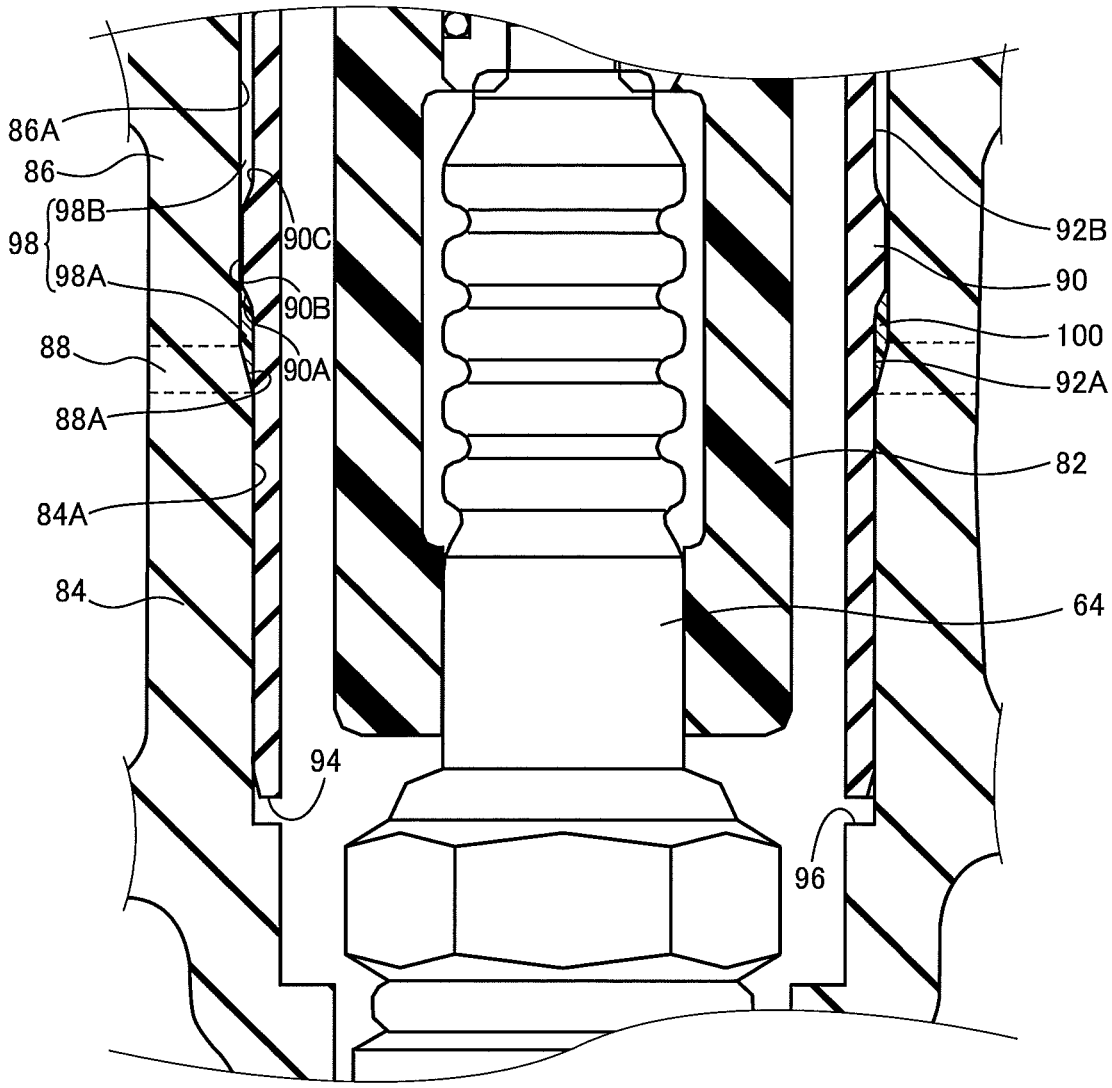
FIG. 7 is an enlarged cross-sectional view of a portion of FIG. 5.

The surrounding wall 76 will be described with reference to FIG. 7. FIG. 7 is an enlarged cross-sectional view of a portion of FIG. 5. The surrounding wall 76 includes a first surrounding wall portion 84, second surrounding wall portion 86 and third surrounding wall portion 88.

The first surrounding wall portion 84 includes a first inner periphery portion 84A. The first inner periphery portion 84A extends in a height direction of the first surrounding wall portion 84 with a generally constant inner diameter. One end of the pipe 66 as measured in an axial direction thereof is pressed in against the first surrounding wall portion 84.

The second surrounding wall portion 86 includes a second inner periphery portion 86A. The second inner periphery portion 86A extends in a height direction of the second surrounding wall portion 86 with a generally constant inner diameter. The second surrounding wall portion 86 is located more distant from the attachment portion 74 than the first surrounding wall portion 84 is. The second surrounding wall portion 86 has an inner diameter that is larger than that of the first surrounding wall portion 84. In other words, the inner diameter of the second inner periphery portion 86A is larger than that of the first inner periphery portion 84A.

The third surrounding wall portion 88 is located between the first and second surrounding wall portions 84 and 86 as measured in a height direction of the surrounding wall 76. The third surrounding wall portion 88 couples the first surrounding wall portion 84 with the second surrounding wall portion 86. The third surrounding wall portion 88 includes a third inner periphery portion 88A. The third inner periphery portion 88A is a tapered inner periphery portion with an inner diameter that increases as it extends from the first surrounding wall portion 84 toward the second surrounding wall portion 86. The third inner periphery portion 88A connects the first inner periphery portion 84A with the second inner periphery portion 86A.

Figure 8:
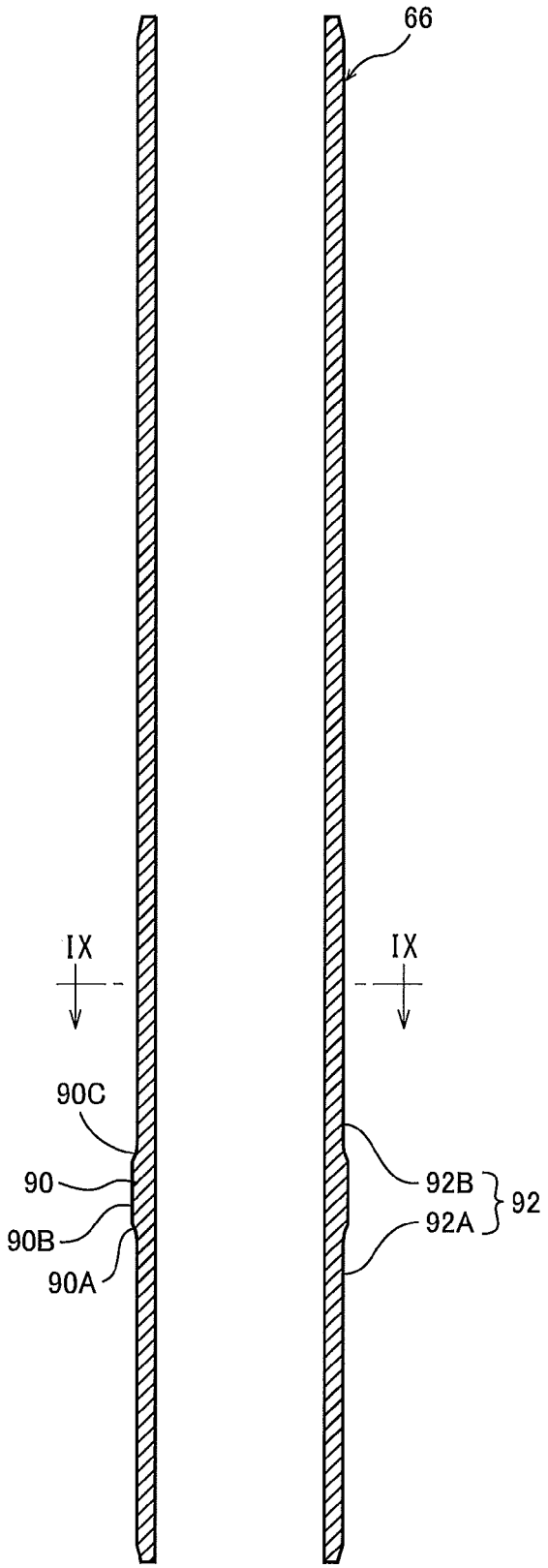
FIG. 8 is a vertical cross-sectional view of the pipe.
Figure 9:
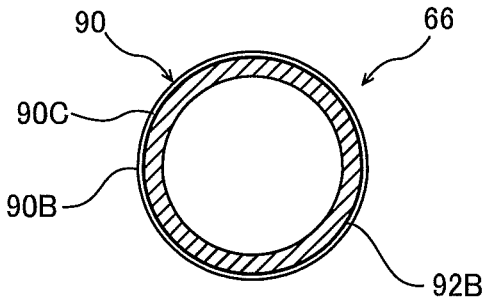
FIG. 9 is a cross-sectional view of the pipe taken on line IX-IX of FIG. 8.

The pipe 66 will be described with reference to FIGS. 8 and 9. FIG. 8 is a vertical cross-sectional view of the pipe 66. FIG. 9 is a cross-sectional view of the pipe taken on line IX-IX of FIG. 8.

The pipe 66 includes an annular projection 90. The annular projection 90 projects from the outer periphery 92 of the pipe 66. The outer periphery 92 includes a first outer periphery portion 92A located closer to the one end of the pipe 66 as measured in an axial direction thereof than the annular projection 90 is, and a second outer periphery portion 92B located closer to the other end of the pipe 66 as measured in an axial direction thereof than the annular projection 90 is. The first outer periphery portion 92A extends in an axial direction of the pipe 66 with a generally constant outer diameter. More specifically, the first outer periphery portion 92A extends from one end of the annular projection 90 as measured in an axial direction thereof to the one end of the pipe 66 as measured in an axial direction thereof. The second outer periphery portion 92B extends in an axial direction of the pipe 66 with a generally constant outer diameter. More specifically, the second outer periphery portion 92B extends from the other end of the annular projection 90 as measured in an axial direction thereof to the other end of the pipe 66 as measured in an axial direction thereof, with the same outer diameter as that of the first outer periphery portion 92A. In other words, the annular projection 90 is the only portion of the pipe 66 that projects from the outer periphery 92.

Since the annular projection 90 is provided, when the one end of the pipe 66, i.e., a portion of the outer periphery that is to be pressed in against the first surrounding wall portion 84 (i.e. the first outer periphery portion 92A) is treated so as to be suitable for pressing-in, for example, the annular projection 90 may serve as a mark. This will improve workability during that treatment.

The annular projection 90 includes a first outer periphery portion 90A, second outer periphery portion 90B and third outer periphery portion 90C. The first outer periphery portion 90A is a tapered outer periphery portion with an outer diameter that increases as it goes from the one end of the pipe 66 as measured in an axial direction thereof toward the other end of the pipe. The first outer periphery portion 90A connects the first outer periphery portion 92A with the second outer periphery portion 90B. The second outer periphery portion 90B extends in an axial direction of the pipe 66 with a generally constant outer diameter. The second outer periphery portion 90B has a larger outer diameter than that of the first and second outer periphery portions 92A and 92B. The third outer periphery portion 90C is a tapered outer periphery portion with an outer diameter that decreases as it goes from the one end of the pipe 66 as measured in an axial direction thereof toward the other end of the pipe. The third outer periphery portion 90C connects the second outer periphery portion 90B with the second outer periphery portion 92B.

As shown in FIG. 7, the one end of the pipe 66 is pressed in against the first outer periphery portion 84. At this moment, the first outer periphery portion 92A is in close contact with the first inner periphery portion 84A. A gap extending in an axial direction of the pipe 66 is located between the one end 94 of the pipe 66 as measured in an axial direction thereof and the annular surface 96. The annular surface 96 is located on the surrounding wall 74. The annular surface 96 expands in directions perpendicular or substantially perpendicular to a height direction of the first inner periphery portion 84A. The outer edge of the annular surface 96 is connected with one end of the first inner periphery portion 84A as measured in a height direction thereof. The gap between the one end 94 of the pipe 66 and the annular surface 86 may be provided by, for example, using a suitable jig to adjust the amount by which the one end of the pipe 66 is pressed in against the first surrounding wall portion 84.

As shown in FIG. 7, when the one end of the pipe 66 is pressed in against the first surrounding wall portion 84, the annular projection 90 divides the space 98 defined by the outer periphery 92 of the pipe 66 and the second inner periphery portion 86A into subspaces arranged in an axial direction of the pipe 66. More specifically, when the one end of the pipe 66 is pressed in against the first surrounding wall portion 84, the second outer periphery portion 90B is in contact with the second inner periphery portion 86A. Thus, a first subspace 98A is located closer to the one end of the pipe 66 as measured in an axial direction thereof than the annular projection 90 is, while a second subspace 98B is located closer to the other end of the pipe 66 as measured in an axial direction thereof than the annular projection 90 is. The first subspace 98A is an annular space defined by the first outer periphery portion 90A, first outer periphery portion 92A, third inner periphery portion 88A and second inner periphery portion 86A, and is secluded from the outside. The second subspace 98B is an annular space defined by the third outer periphery portion 90C, second outer periphery portion 92B and second inner periphery portion 86A.

A liquid gasket 100 is contained in the first subspace 98A. The liquid gasket 100 sticks to the one end of the pipe 66. In other words, the liquid gasket 100 sticks to some of the portions of the pipe 66 that are pressed in against the first surrounding wall portion 84. In yet other words, the liquid gasket 100 sticks to the first outer periphery portion 92A.

Preferred methods for causing the liquid gasket 100 to stick to the first outer periphery portion 92A include, but are not limited to, the following: first, a trough containing gasket liquid is prepared; next, the portions of the pipe 66 located closer to the one end thereof than the annular projection 90 is as measured in an axial direction of the pipe are immersed in the gasket liquid in the trough; thereafter, the pipe 66 is removed to dry the liquid gasket 100 sticking to the one end of the pipe 66. Thus, the liquid gasket 100 sticks to the first outer periphery portion 92A.

In the above method, gasket liquid sticks not only to the first outer periphery portion 92A but also to the inner periphery of the pipe 66 since the one end of the pipe 66 is immersed in the gasket liquid in the trough. Gasket liquid sticking to the inner periphery of the pipe 66 presents no problem during assembly of the engine 22 and other processes.

While the surface of the liquid gasket 100 sticking to the first outer periphery portion 92A is dry, the interior of the liquid gasket 100 is not dry. As such, when the one end of the pipe 66 is pressed in against the first surrounding wall portion 84, the liquid gasket 100 is scraped together by the third inner periphery portion 88A. As a result, the liquid gasket 100 is contained in the first subspace 98A. At this moment, the liquid gasket 100 may move into the gap between the first surrounding wall portion 84 and the press-in surface of the pipe 66.

The volume of the first subspace 98A may be larger than the volume of the liquid gasket 100, but is preferably smaller than the volume of the liquid gasket 100, for example. In this case, the liquid gasket 100 is compressed and contained in the first subspace 98A. This further improves the seal performance of the liquid gasket 100. The volume of the first subspace 98A may be adjusted by changing the location of the annular projection 90 (i.e., a location as measured in an axial direction of the pipe 66) or by changing the amount by which the pipe 66 is pressed in against the first surrounding wall portion 84.

Figure 10:
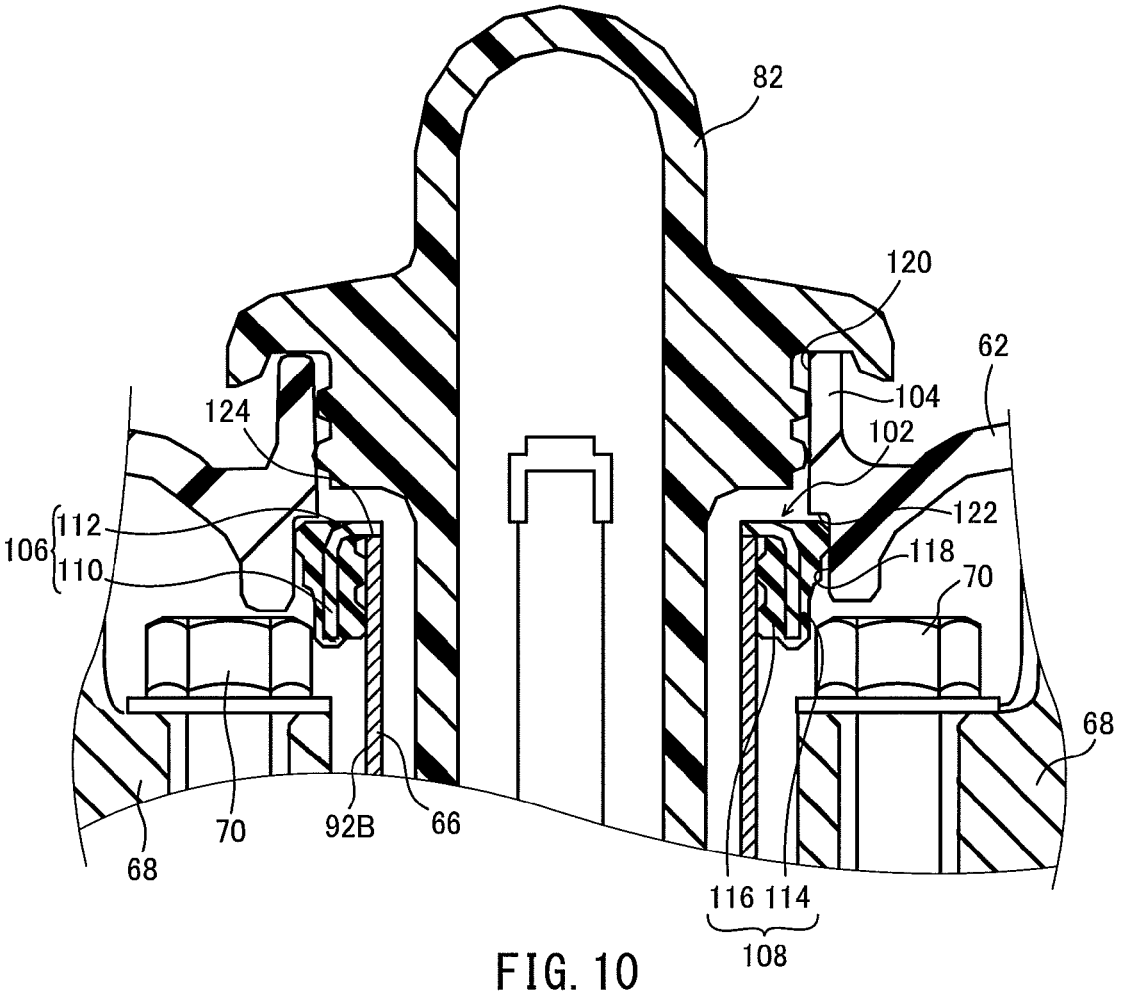
FIG. 10 is an enlarged cross-sectional view of a portion of FIG. 6.

As shown in FIG. 10, the head cover 62 includes a cylindrical wall 104. When the head cover 62 is attached to the cylinder head 60, the cylindrical wall 104 is located around the pipe 66. More specifically, the cylindrical wall 104 is located around the other end of the pipe 66 as measured in an axial direction thereof, i.e. the end of the pipe 66 as measured in an axial direction thereof that is opposite to the end that is pressed in against the first surrounding wall portion 84.

The cylindrical wall 104 includes a first inner periphery portion 118, second inner periphery portion 120 and step surface 122. The first inner periphery portion 118 extends in a height direction of the cylindrical wall 104 with a generally constant inner diameter. The second inner periphery portion 120 is located more distant from the spark plug 64 than the first inner periphery portion 118 is as measured in an axial direction of the pipe 66, i.e., a height direction of the cylindrical wall 104. The second inner periphery portion 120 extends in a height direction of the cylindrical wall 104 with a generally constant inner diameter. The second inner periphery portion 120 has a smaller inner diameter than that of the first inner periphery portion 118. The step surface 122 expands in directions perpendicular or substantially perpendicular to an axial direction of the pipe 66, i.e., a height direction of the cylindrical wall 104. The step surface 122 connects the first inner periphery portion 118 with the second inner periphery portion 120.

A seal member 102 is disposed between the inner periphery of the cylindrical wall 104 (or more particularly, the first inner periphery portion 118) and the outer periphery portion 92B of the pipe 66. The seal member 102 includes a support clasp 106 and seal rubber 108.

The support clasp 106 includes a cylindrical portion 110 and a stop piece 112 that defines and serves as the stop. The cylindrical portion 110 is located between the pipe 66 and the cylindrical wall 104. The stop piece 112 is defined by an end of the cylindrical portion 110 as measured in an axial direction thereof and has a smaller inner diameter than that of the cylindrical portion 110.

The seal rubber 108 includes a first rubber portion 114 and a second rubber portion 116. The first rubber portion 114 is bonded to the outer periphery of the cylindrical portion 110. The first rubber portion 114 is compressed by the cylindrical portion 110 and cylindrical wall 104. This provides a seal between the cylindrical portion 110 and cylindrical wall 104. The second rubber portion 116 is bonded to the inner periphery of the cylindrical portion 110. The second rubber portion 116 is compressed by the cylindrical portion 110 and pipe 66. This provides a seal between the cylindrical portion 110 and pipe 66.

As viewed in an axial direction of the pipe 66 when the seal member 102 is located between the first inner periphery portion 118 and second outer periphery portion 92B, the stop piece 112 overlaps the other end 124 of the pipe 66 as viewed in an axial direction thereof. In the present preferred embodiment, the stop piece 112 is in contact with the other end 124 of the pipe 66. As viewed in an axial direction of the pipe 66 when the seal member 102 is located between the first inner periphery portion 118 and second outer periphery portion 92B, the seal member 102 (or, more particularly, the first rubber portion 114) overlaps the step surface 122.

A motorcycle 10 includes an engine 22. The engine 22 includes a cylinder head 60, a spark plug 64 and a pipe 66. The spark plug 64 is attached to the cylinder head 60. The pipe 66 is located around the spark plug 64. The cylinder head 60 includes an attachment portion 74 and a surrounding wall 76. The spark plug 64 is attached to the attachment portion 74. The surrounding wall 76 is located around the spark plug 64. The surrounding wall 76 includes a first surrounding wall portion 84 and a second surrounding wall portion 86. One end of the pipe 66 is pressed in against the first surrounding wall portion 84. The second surrounding wall portion 86 is located more distant from the attachment portion 74 than the first surrounding wall portion 84 is, and has an inner diameter larger than that of the first surrounding wall portion 84. The pipe 66 includes an annular projection 90. The annular projection 90 projects from the outer periphery 92A and 92B of the pipe 66, and divides the space 98 defined by the outer periphery 92B of the pipe 66 and the inner periphery 86A of the second surrounding wall portion 86 into subspaces arranged in an axial direction of the pipe 66 when the one end of the pipe 66 is pressed in against the first surrounding wall portion 84. A liquid gasket 100 is contained in a first subspace 98A which is closer to the first surrounding wall portion 84 than the annular projection 90 is.

In the engine 22, the pipe 66 is pressed in against the first surrounding wall portion 84. Pressing in the pipe provides a seal between the outer periphery 92A of the pipe 66 and the inner periphery 84A of the first surrounding wall portion 84.

Further, in the engine 22, the liquid gasket 100 is contained in the first subspace 98A, which is the one of the subspaces 98 defined between the outer periphery 92B of the pipe 66 and the inner periphery 86A of the second surrounding wall portion 86 that is closer to the first surrounding wall portion 84 than the annular projection 90 is. The liquid gasket 100 provides a seal between the outer periphery 92B of the pipe 66 and the inner periphery 86A of the second surrounding wall portion 86.

In the above engine 22, a seal structure implemented by a liquid gasket 100 is preferably included in addition to the seal structure implemented by pressing in the pipe. The seal structure implemented by the liquid gasket 100 further improves the seal performance of the seal structure implemented by pressing in the pipe.

In addition, in the engine 22, the annular projection 90 prevents the liquid gasket 100 from leaking from the first subspace 98A into the second subspace 98B.

Thus, in the engine 22, a seal between the surrounding wall 76 and pipe 66 is easily provided.

In the engine 22, the surrounding wall 76 includes a third surrounding wall portion 88. The third surrounding wall portion 88 is located between the first and second surrounding wall portions 84 and 86 as measured in a height direction of the surrounding wall 76 and couples the first surrounding wall portion 84 with the second surrounding wall portion 86. The third surrounding wall portion 88 includes a tapered inner periphery 88A. The tapered inner periphery 88A connects the inner periphery 84A of the first surrounding wall portion 84 with the inner periphery 86A of the second surrounding wall portion 86, and has an inner diameter that increases as it goes from the first surrounding wall portion 84 toward the second surrounding wall portion 86.

In this implementation, the liquid gasket 100 easily enters the gap between the pipe 66 and the press-in surface of the first surrounding wall portion 84 due to wedge effects. As such, the seal property between the pipe 66 and the surrounding 76 wall is significantly improved.

In the engine 22, the surrounding wall 76 further includes an annular surface 96. The annular surface 96 is connected with the inner periphery 84A of the first surrounding wall portion 84 and expands in directions perpendicular or substantially perpendicular to a height direction of the first surrounding wall portion 84. When the one end of the pipe 66 is pressed in against the first surrounding wall portion 84, a gap is defined between the one end 94 of the pipe 66 and the annular surface 96.

In this implementation, the size of the gap defined between the one end 94 of the pipe 66 and the annular surface 96 is adjusted appropriately to compress the liquid gasket 100 in the first subspace 98A. As a result, the seal property between the pipe 66 and surrounding wall 76 is significantly improved.

Further, when the pipe 66 is pressed in, the pipe 66 is prevented from buckling since the one end 94 of the pipe 66 does not contact the annular surface 96.

The engine 22 further includes a head cover 62. The head cover 62 is attached to the cylinder head 60. The head cover 62 includes a cylindrical wall 104. When attached to the cylinder head 60, the cylindrical wall 104 is located around the pipe 66. The engine 22 further includes a seal member 102. The seal member 102 is located between the inner periphery 118 of the cylindrical wall 104 and the outer periphery 92B of the pipe 66.

In this implementation, a seal is provided between the head cover 62 and pipe 66.

In the engine 22, the cylindrical wall 104 is located around the other end of the pipe 66 which is opposite the one end as measured in an axial direction of the pipe 66. The seal member 102 includes a stop 112. The stop 112 is located more distant from the spark plug 64 than the other end 124 of the pipe 66 as measured in an axial direction of the pipe 66. The stop 112 overlaps the other end 124 as viewed in an axial direction of the pipe 66.

In this implementation, movement of the pipe 66 in an axial direction may be restricted. As such, the pipe 66 may be prevented from moving out of the first surrounding wall portion 84.

In the engine 22, the stop 112 is in contact with the other end 124 when the seal member 102 is located between the inner periphery 118 of the cylindrical wall 104 and the outer periphery 92B of the pipe 66.

In this implementation, the pipe 66 is prevented from moving out of the first surrounding wall portion 84.

In the engine 22, the seal member 102 includes a support clasp 106 and seal rubber 108. The seal rubber 108 is bonded to the support clasp 106. The support clasp 106 includes a cylindrical portion 110 and a stop piece 112. The cylindrical portion 110 is located between the pipe 66 and the cylindrical wall 104. The stop piece 112 is located more distant from the spark plug 64 than the other end 124 of the pipe 66 is as measured in an axial direction of the pipe 66. The stop piece 112 overlaps the other end 124 of the pipe 66 as viewed in an axial direction of the pipe 66. The stop piece 112 defines the stop.

In this implementation, a portion of the support clasp 106 (i.e., the stop piece 112) defines the stop, thus ensuring a certain strength of the stop.

In the engine 22, the seal rubber 108 includes a first rubber portion 114 and a second rubber portion 116. The first rubber portion 114 is bonded to the outer periphery of the cylindrical portion 110. The second rubber portion 116 is bonded to the inner periphery of the cylindrical portion 110. When the seal member 102 is located between the inner periphery 118 of the cylindrical wall 104 and the outer periphery 92B of the pipe 66, the first rubber portion 114 is compressed between the cylindrical portion 110 and the cylindrical wall 104 and the second rubber portion 116 is compressed between the cylindrical portion 110 and the pipe 66.

In this implementation, the first rubber portion 114 is compressed between the cylindrical portion 110 and the cylindrical wall 104, thus providing a seal between the cylindrical portion 110 and the cylindrical wall 104. Further, the second rubber portion 116 is compressed between the cylindrical portion 110 and the pipe 66, thus providing a seal between the cylindrical portion 110 and the pipe 66.

In the engine 22, the cylindrical wall 104 includes a first inner periphery portion 118, a second inner periphery portion 120 and a step surface 122. The second inner periphery portion 120 is located more distant from the spark plug 64 than the first inner periphery portion 118 is as measured in an axial direction of the pipe 66, and has an inner diameter smaller than that of the first inner periphery portion 118. The step surface 122 connects the first inner periphery portion 118 with the second inner periphery portion 120. The seal member 102 is located between the first inner periphery portion 118 and the outer periphery 92B of the pipe 66. The seal member 102 overlaps the step surface 122 as viewed in an axial direction of the pipe 66.

In this implementation, the seal member 102 is prevented from moving out of between the cylindrical wall 104 and the pipe 66.

While the preferred embodiment illustrated above describes a motocrosser-type motorcycle, the present invention is not limited to such a configuration. For example, the vehicle may be a motorcycle other than motocrosser-type motorcycles, or may be three- or four-wheeled leaning vehicle.

While preferred embodiments of the present invention have been described, the preferred embodiments above are merely examples for carrying out the present invention. Thus, the present invention is not limited to the preferred embodiments above, and the above preferred embodiments may be modified as necessary without departing from the spirit of the present invention.

What is claimed is:

1. An engine comprising:

a cylinder head;

a spark plug attached to the cylinder head; and a pipe located around the spark plug; wherein the cylinder head includes:

an attachment portion to which the spark plug is attached; and a surrounding wall located around the spark plug and extending in a first direction, the first direction being an axial direction of the pipe;

the surrounding wall includes:

a first surrounding wall portion against which one end of the pipe is pressed in; and a second surrounding wall portion located more distant from the attachment portion than the first surrounding wall portion is as measured in the first direction, and having an inner diameter larger than that of the first surrounding wall portion;

the pipe includes an annular projection projecting from an outer periphery of the pipe to divide a space defined by the outer periphery of the pipe and an inner periphery of the second surrounding wall portion into subspaces arranged in the first direction when the one end of the pipe is pressed in against the first surrounding wall portion; and a liquid gasket is included in a first subspace which is closer to the first surrounding wall portion than the annular projection is.

2. The engine according to claim 1, wherein the surrounding wall includes a third surrounding wall portion located between the first and second surrounding wall portions as measured in the first direction to couple the first surrounding wall portion with the second surrounding wall portion; and the third surrounding wall portion includes a tapered inner periphery that connects an inner periphery of the first surrounding wall portion with the inner periphery of the second surrounding wall portion, and having an inner diameter that increases as it goes from the first surrounding wall portion toward the second surrounding wall portion.

3. The engine according to claim 1, wherein the surrounding wall further includes an annular surface connected with an inner periphery of the first surrounding wall portion and expanding in directions perpendicular or substantially perpendicular to the first direction; and when the one end of the pipe is pressed in against the first surrounding wall portion, a gap is defined between the one end of the pipe and the annular surface.

4. The engine according to claim 1, further comprising:

a head cover attached to the cylinder head, the head cover including a cylindrical wall which is attached to the cylinder head and is located around the pipe; and a seal member located between an inner periphery of the cylindrical wall and the outer periphery of the pipe.

5. The engine according to claim 4, wherein the cylindrical wall is located around another end of the pipe which is opposite to the one end as measured in the first direction; and the seal member includes a stop located more distant from the spark plug than the other end of the pipe is as measured in the first direction, the stop overlapping the other end as viewed in the first direction.

6. The engine according to claim 5, wherein the stop is in contact with the other end when the seal member is located between the inner periphery of the cylindrical wall and the outer periphery of the pipe.

7. The engine according to claim 5, wherein the seal member includes:

a support clasp; and seal rubber bonded to the support clasp;

the support clasp includes:

a cylindrical portion located between the pipe and the cylindrical wall; and a stop piece located more distant from the spark plug than the other end is as measured in the first direction, the stop piece overlapping the other end as viewed in the first direction; and the stop piece defines the stop.

8. The engine according to claim 7, wherein the seal rubber includes:

a first rubber portion bonded to an outer periphery of the cylindrical portion; and a second rubber portion bonded to an inner periphery of the cylindrical portion; and when the seal member is located between the inner periphery of the cylindrical wall and the outer periphery of the pipe, the first rubber portion is compressed between the cylindrical portion and the cylindrical wall and the second rubber portion is compressed between the cylindrical portion and the pipe.

9. The engine according to claim 4, wherein the cylindrical wall includes:

a first inner periphery portion;

a second inner periphery portion located more distant from the spark plug than the first inner periphery portion is as measured in the first direction, and having an inner diameter smaller than that of the first inner periphery portion; and a step surface that connects the first inner periphery portion with the second inner periphery portion;

the seal member is located between the first inner periphery portion and the outer periphery of the pipe; and the seal member overlaps the step surface as viewed in the first direction.

10. A straddle-type vehicle including the engine according to claim 1.

* * * * *